US008061166B2

(12) United States Patent
Tsai

(10) Patent No.: US 8,061,166 B2
(45) Date of Patent: Nov. 22, 2011

(54) DOOR LOCK WITH TRANSMISSION MECHANISM

(75) Inventor: Miao-Hsueh Tsai, Taichung (TW)

(73) Assignee: Imperial Hardware Taiwan, Ltd., Taichung (TW)

( * ) Notice: Subject to any disclaimer, the term of this patent is extended or adjusted under 35 U.S.C. 154(b) by 0 days.

(21) Appl. No.: 12/253,983

(22) Filed: Oct. 19, 2008

(65) Prior Publication Data

US 2010/0263416 A1 Oct. 21, 2010

(51) Int. Cl.
*E05B 59/00* (2006.01)

(52) U.S. Cl. ..... 70/107; 70/108; 70/109; 292/35

(58) Field of Classification Search ..... 70/104, 70/107–110, 118; 292/35–37, 32, 41
See application file for complete search history.

(56) References Cited

U.S. PATENT DOCUMENTS

| | | | | |
|---|---|---|---|---|
| 536,957 | A * | 4/1895 | Klein | 70/109 |
| 4,218,903 | A * | 8/1980 | Eads | 70/107 |
| 6,266,981 | B1 * | 7/2001 | von Resch et al. | 70/107 |
| 6,327,881 | B1 * | 12/2001 | Grundler et al. | 70/107 |
| 6,389,855 | B2 * | 5/2002 | Renz et al. | 70/107 |
| 7,856,857 | B2 * | 12/2010 | Tsai | 70/107 |
| 2002/0104339 | A1 * | 8/2002 | Saner | 70/108 |

* cited by examiner

*Primary Examiner* — Suzanne Barrett
(74) *Attorney, Agent, or Firm* — Wang Law Firm, Inc.; Li K. Wang

(57) ABSTRACT

A door lock with transmission mechanism, in which a main lock is installed at the side of the door, and an auxiliary lock is installed at each side of the main lock respectively, whereof the main lock has a main lock-tongue, and each of the two auxiliary lock has an auxiliary lock-tongue, whereby the main lock-tongue drives the auxiliary lock-tongue in each of the two auxiliary locks to move together corresponding to the rotation of door handle.

1 Claim, 13 Drawing Sheets

DOOR LOCK WITH TRANSMISSION MECHANISM

BACKGROUND OF THE INVENTION (a) Field of the Invention

The invention is related to a door lock with transmission mechanism, and is especially related to a door lock, whereof the two sides of the main lock are further installed with auxiliary locks.

(b) Description of the Prior Art

A single lock is usually used in the conventional door lock installed on the door, i.e. the door lock only is only installed with a firmly lockable lock-tongue, or respectively installed with a closing-door lock-tongue and a door-locking lock-head, whereas since the conventional door lock is a single lock, in case there is breaking-door theft, thief can easily break the lock to enter the house for stealing, whereof the main purpose of the invention is trying to solve this said problem.

SUMMARY OF THE INVENTION

The main purpose of the invention is to provide a door lock with transmission mechanism, aiming to solve the above problem, whereof through the two auxiliary locks installed respectively at the two sides of the main lock on the door, the door can be opened only when the auxiliary lock-tongues inside the two side auxiliary locks is cooperated with the reciprocation of the main lock-tongue inside the main lock, thereby to enhance the burglar-proof effect.

To achieve the aforesaid purpose, the invention includes the following:

A lock body is comprised of a stop plate which is closely attached to one side of the door, the middle of the said stop plate is installed with a main lock which is housed inside the door, an auxiliary lock is installed respectively between the main lock and each end of the stop plate, and is housed inside the door similar to the case of main lock, whereof the said main lock is installed with a first locking mechanism and a second locking mechanism while each auxiliary lock is installed with a stop mechanism;

The said first locking mechanism is comprised of a first actuator, whereof one end of the said first actuator is hinged with a first link rod which has a long hole between its two ends. The said long hole is sleeved into a fixed rod. The other end of the first link rod is further hinged with a second link rod which is hinged with another lock at its end, whereof the said lock has a lock-head which is extendable to stop plate and recover, whereof the same end of the said second link rod is further installed with a torsion spring to recover the first link rod back to position after it is;

The said second locking mechanism is comprised of a second actuator, whereof the second actuator is installed with a second torsion spring for recovering the second actuator after its rotation. One end of the second actuator is installed with a shift-lever to turn a brake which has a shift-part, whereof the shift-part is turned to drive a main lock-tongue to extended out of the stop plate and recovered by the push of a third torsion spring;

Each of the two stop mechanisms is comprised of a link bar which is connected with a connection bar, whereof the connecting bar is extended from the auxiliary lock and entered the two sides of main lock, whereof a hinge is driven by the said link bar to connect with one end of a auxiliary lock-tongue in the stop mechanism, whereof the said stop mechanism has a pusher which is pushed by a compression spring 46 at one end while its another end push the bottom end of the said auxiliary lock-tongue, thereby to recover the lock-tongue after it is moved;

A link plate which is installed in the main lock, whereof the link plate is sleeved in the long hole on top of the shift-lever of the second actuator of the second locking mechanism, two ends of the said link plate is respectively connected with the connecting bar of each stop mechanism, further, the said link plate is sleeved in the shift-part of the second locking mechanism, thereby when the brake is turned, the link plate is driven by the shift-part to drive the auxiliary lock-tongue of each stop mechanism for reciprocating movement.

DETAILED DESCRIPTION OF THE PREFERRED EMBODIMENTS

Figure 1:
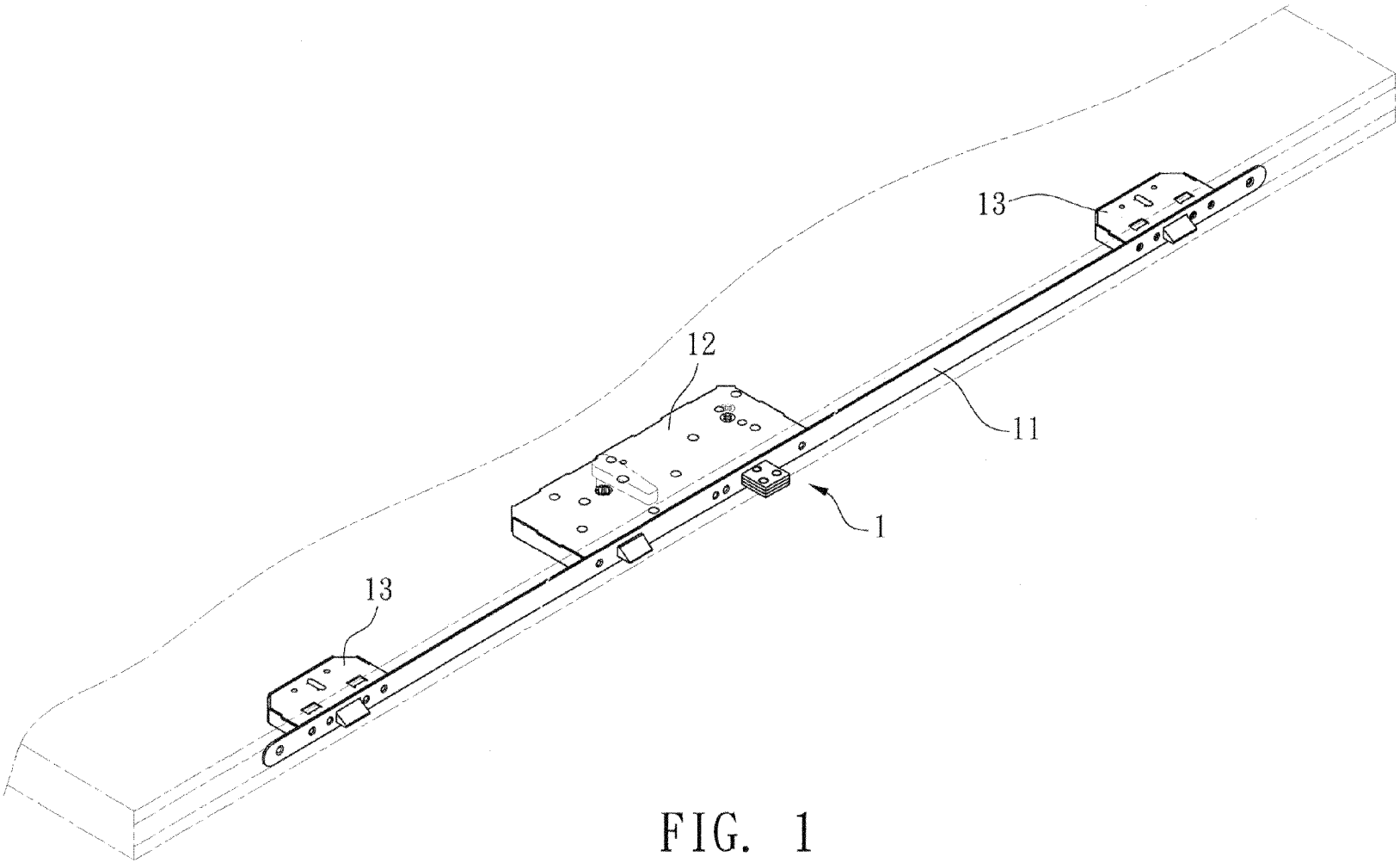
FIG. 1 is a 3D outlook of the invention.
Figure 2:
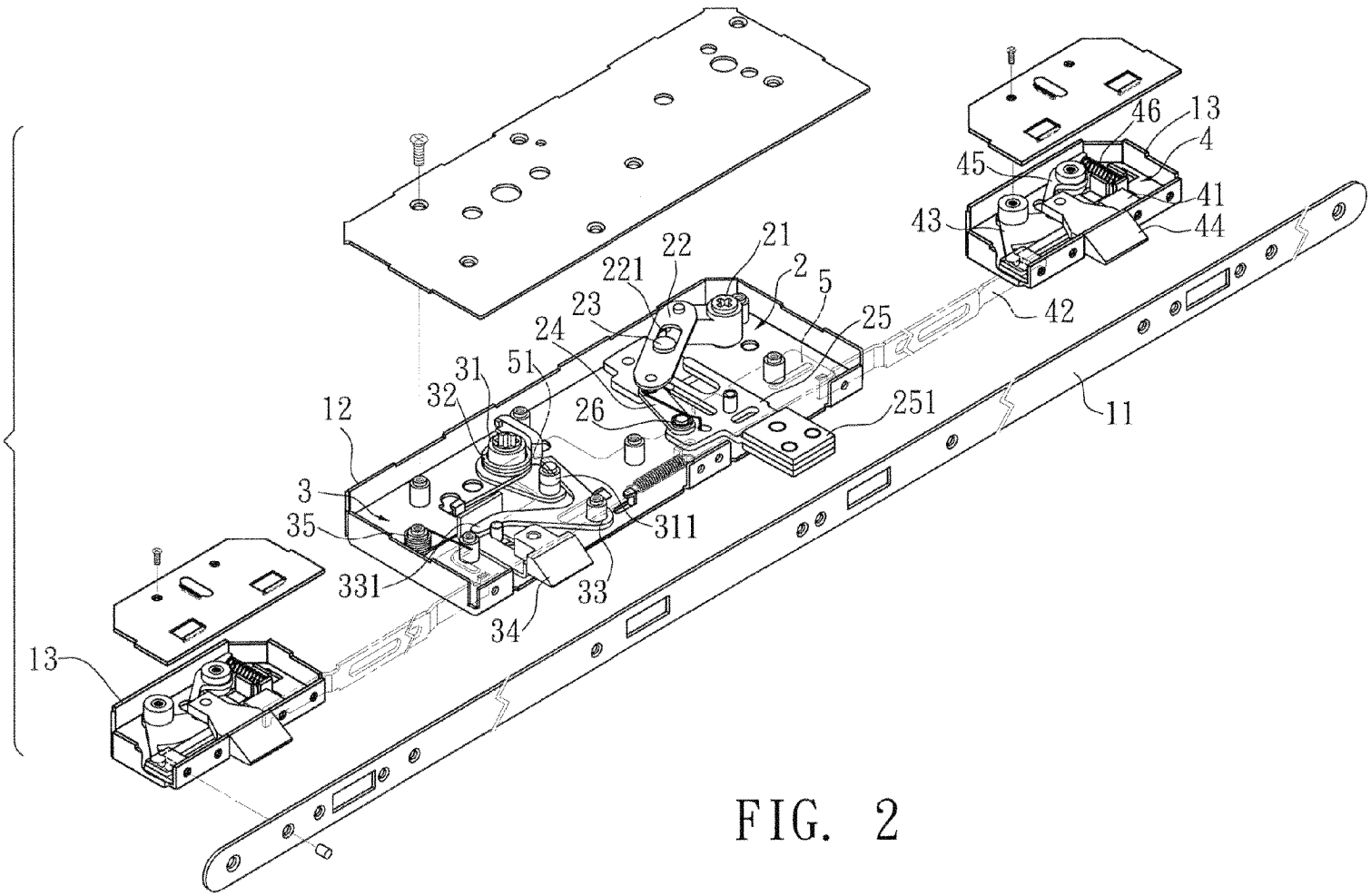
FIG. 2 is a door lock disassembly drawing of the invention.
Figure 3:
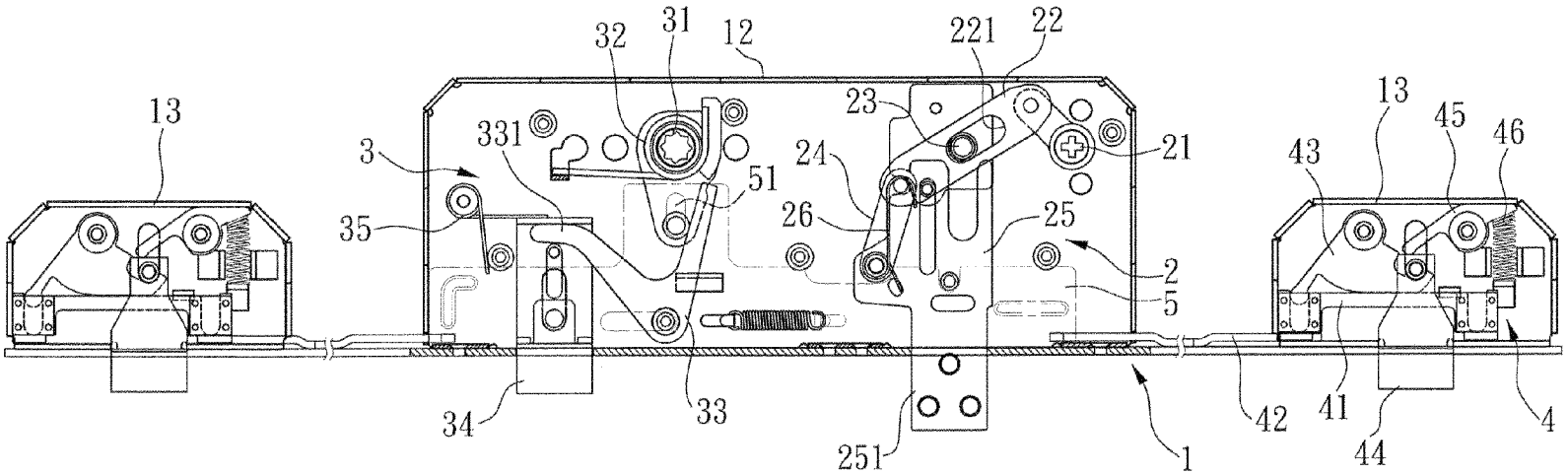
FIG. 3 is a plane schematic view showing a closed door lock of the invention
Figure 4:
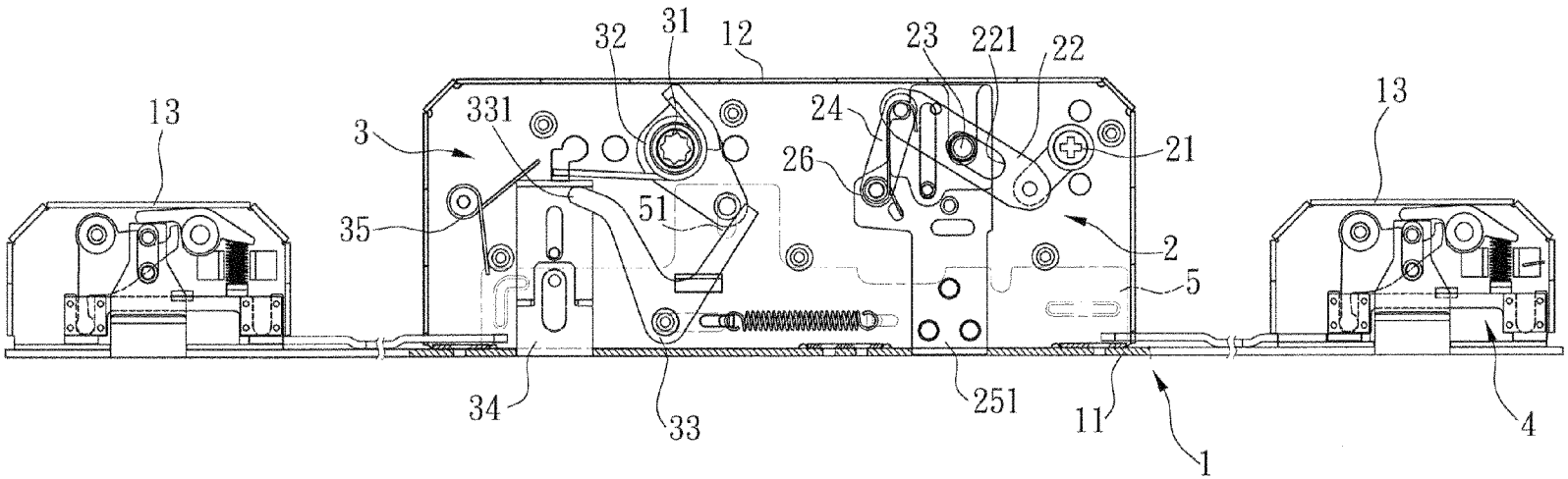
FIG. 4 is a plane schematic view showing an opened door lock of the invention.
Figure 5:
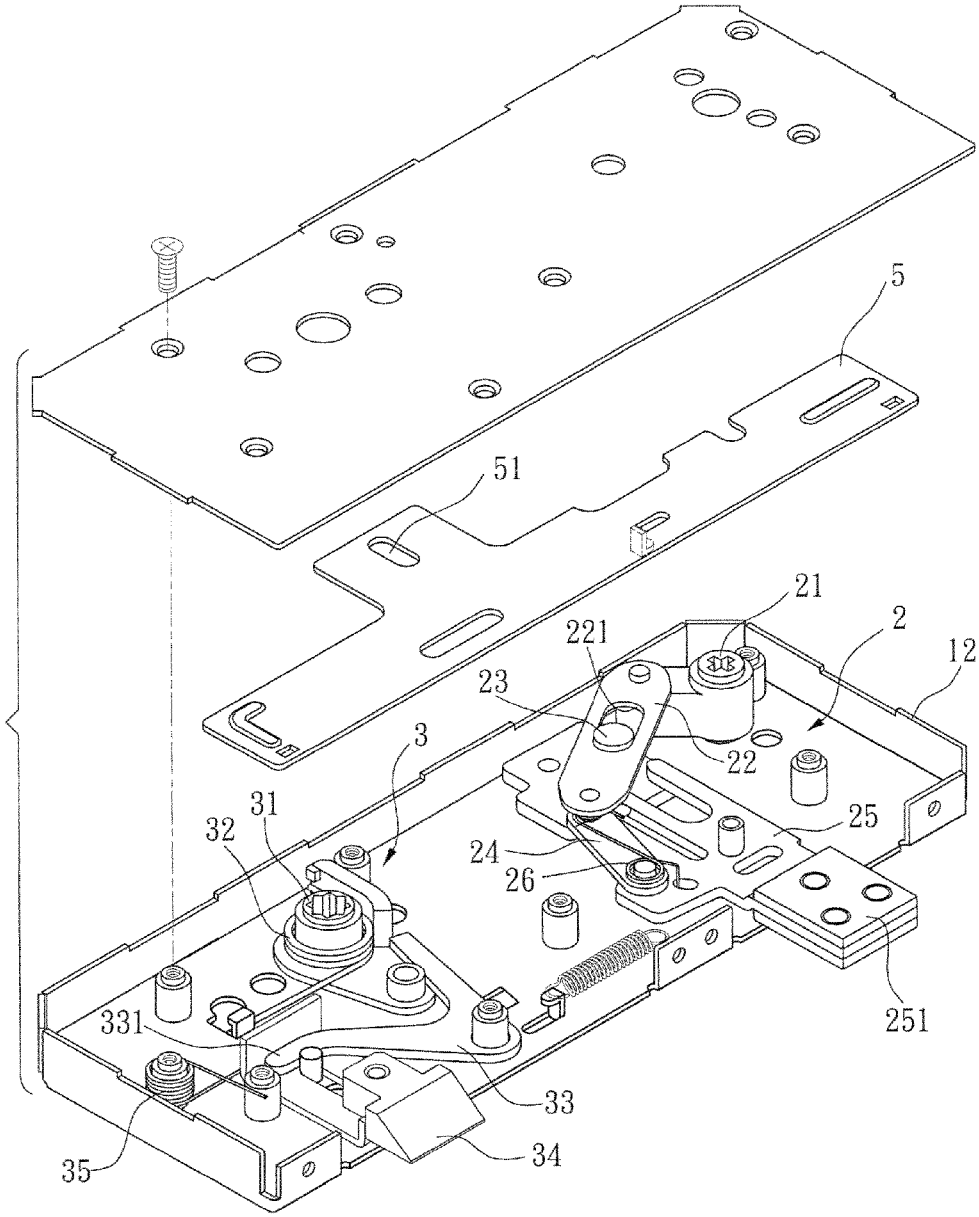
FIG. 5 is a structure schematic drawing showing the main lock of the invention.
Figure 6:
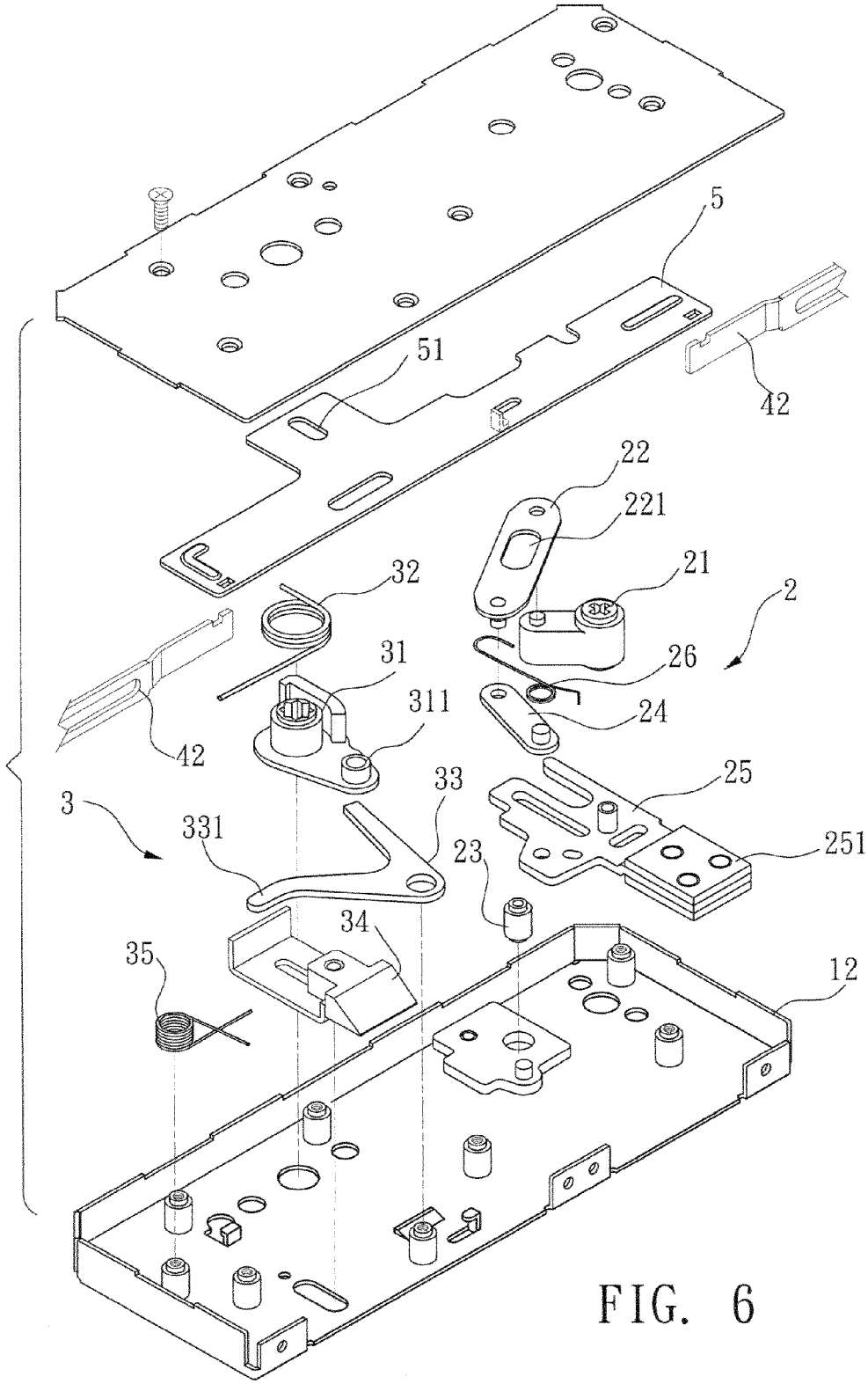
FIG. 6 is a 3D explosion view showing the main lock of the invention.
Figure 7:
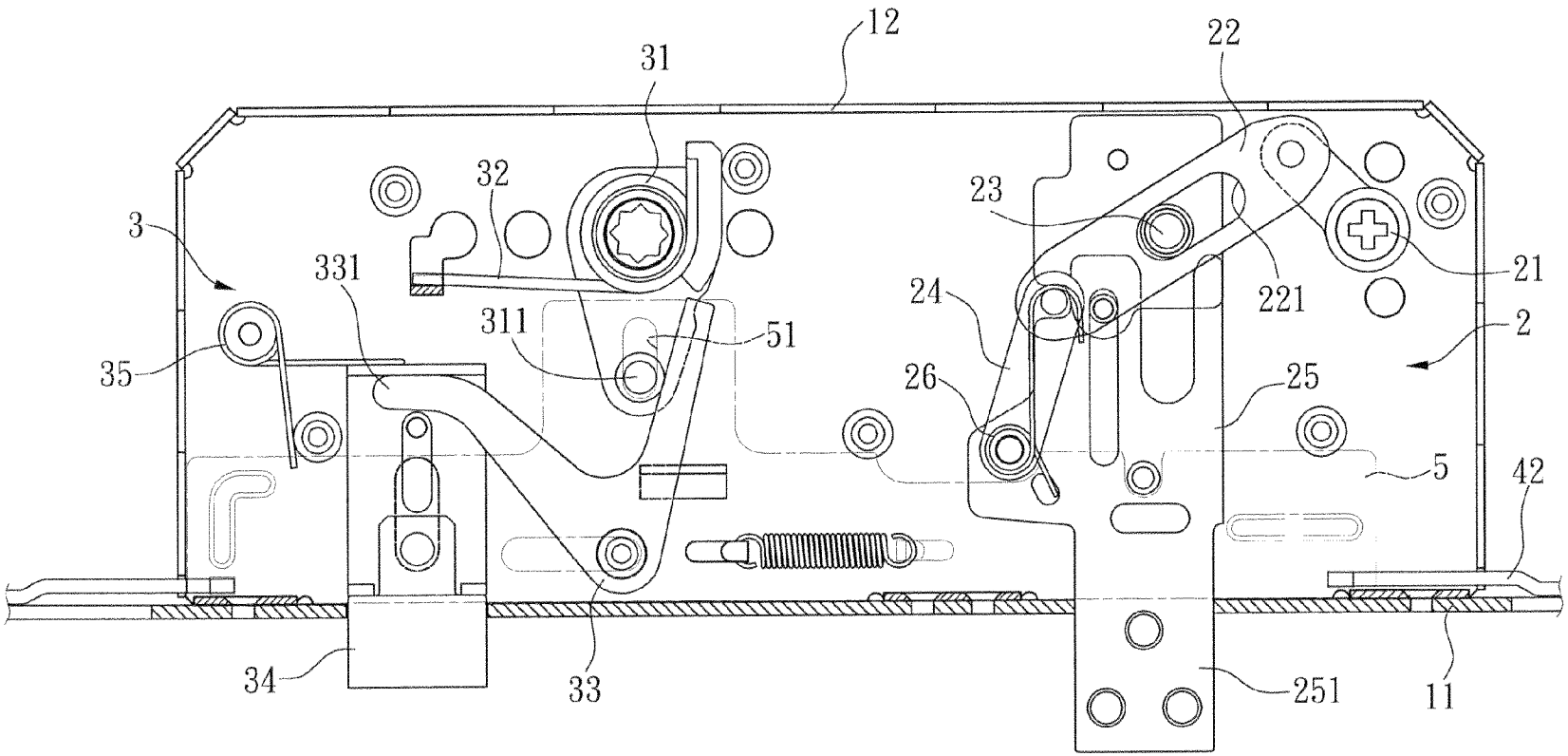
FIG. 7 is a plane schematic view showing a closed main lock of the invention.
Figure 8:
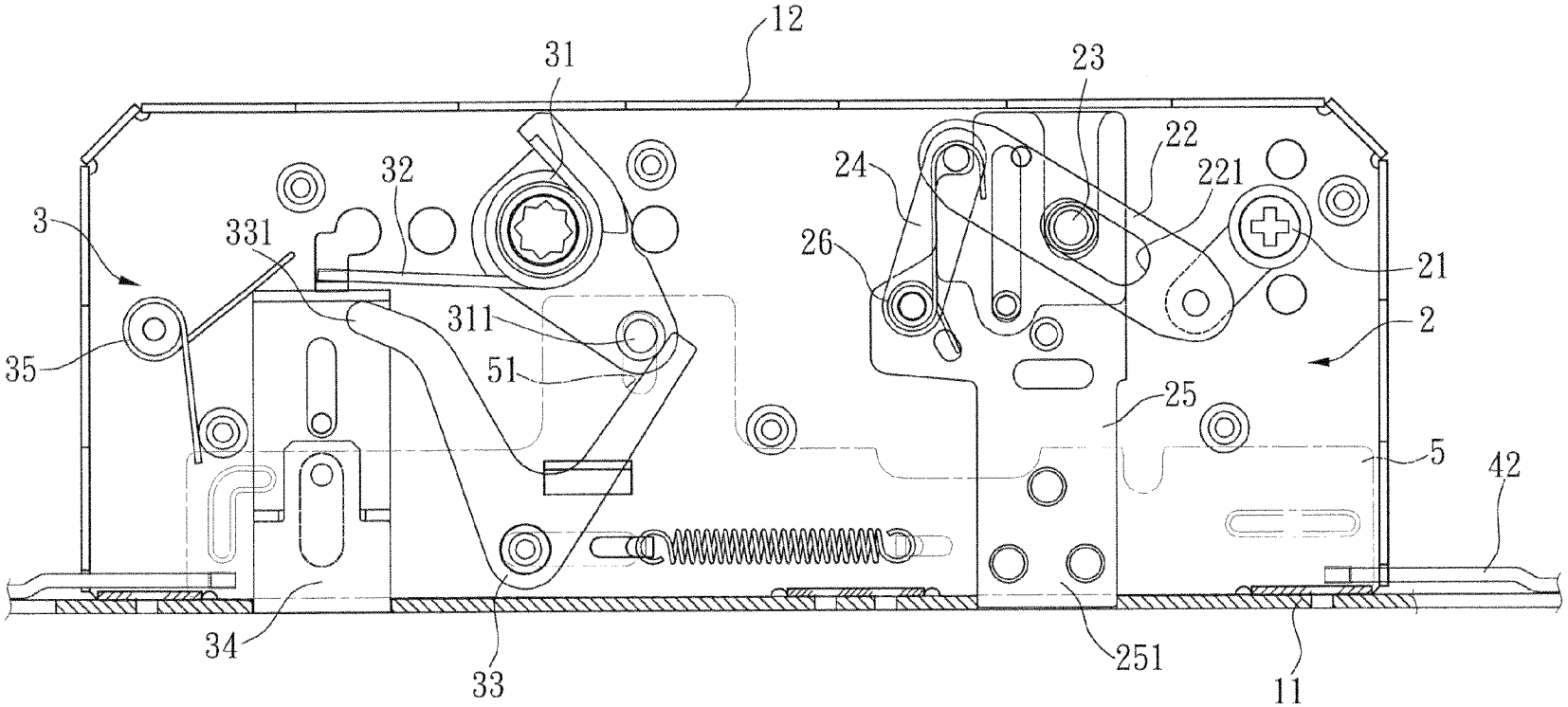
FIG. 8 is a plane schematic view showing an opened door lock of the invention.
Figure 9:
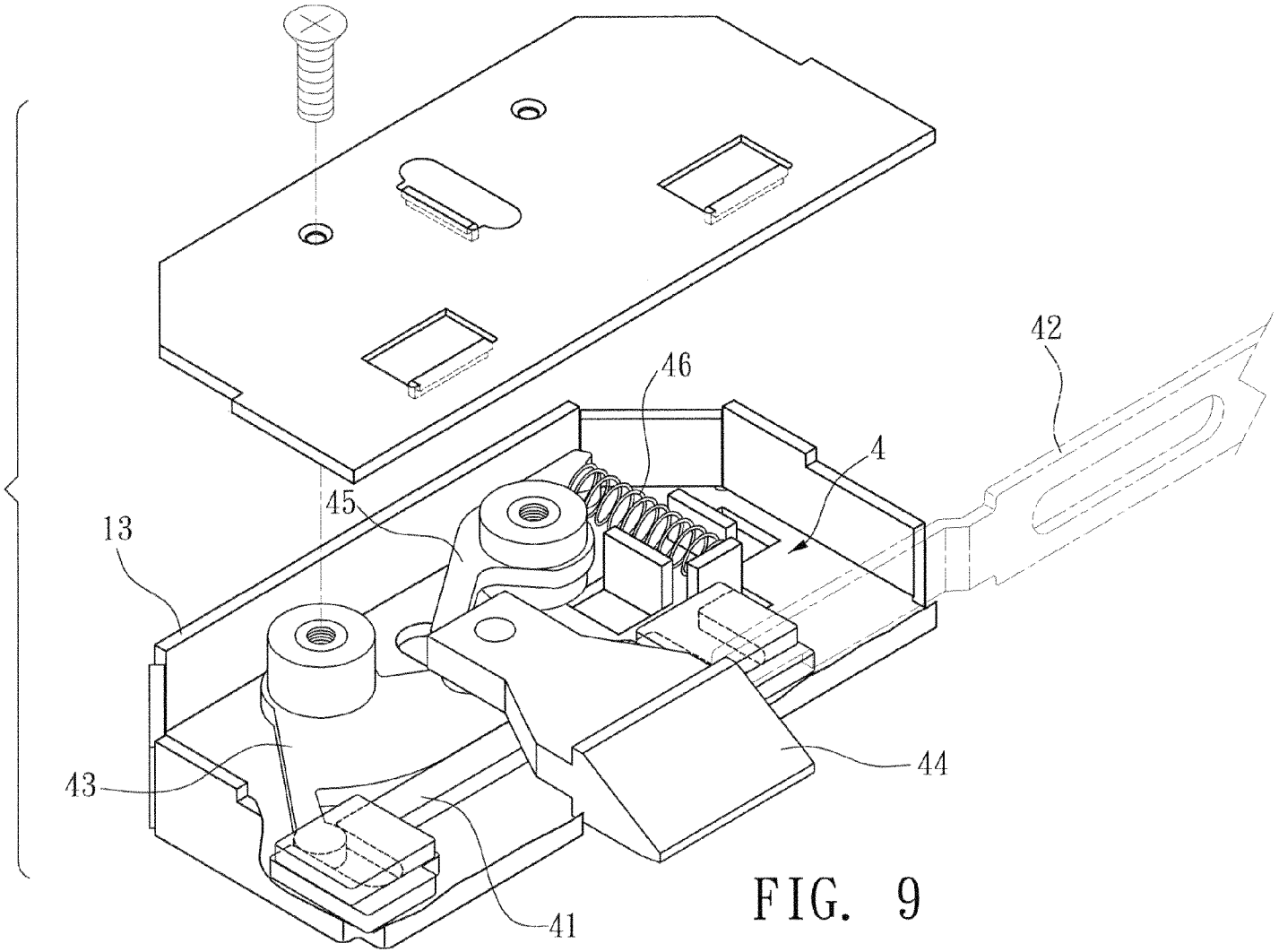
FIG. 9 is a structure schematic drawing showing the left side auxiliary lock of the invention.
Figure 10:
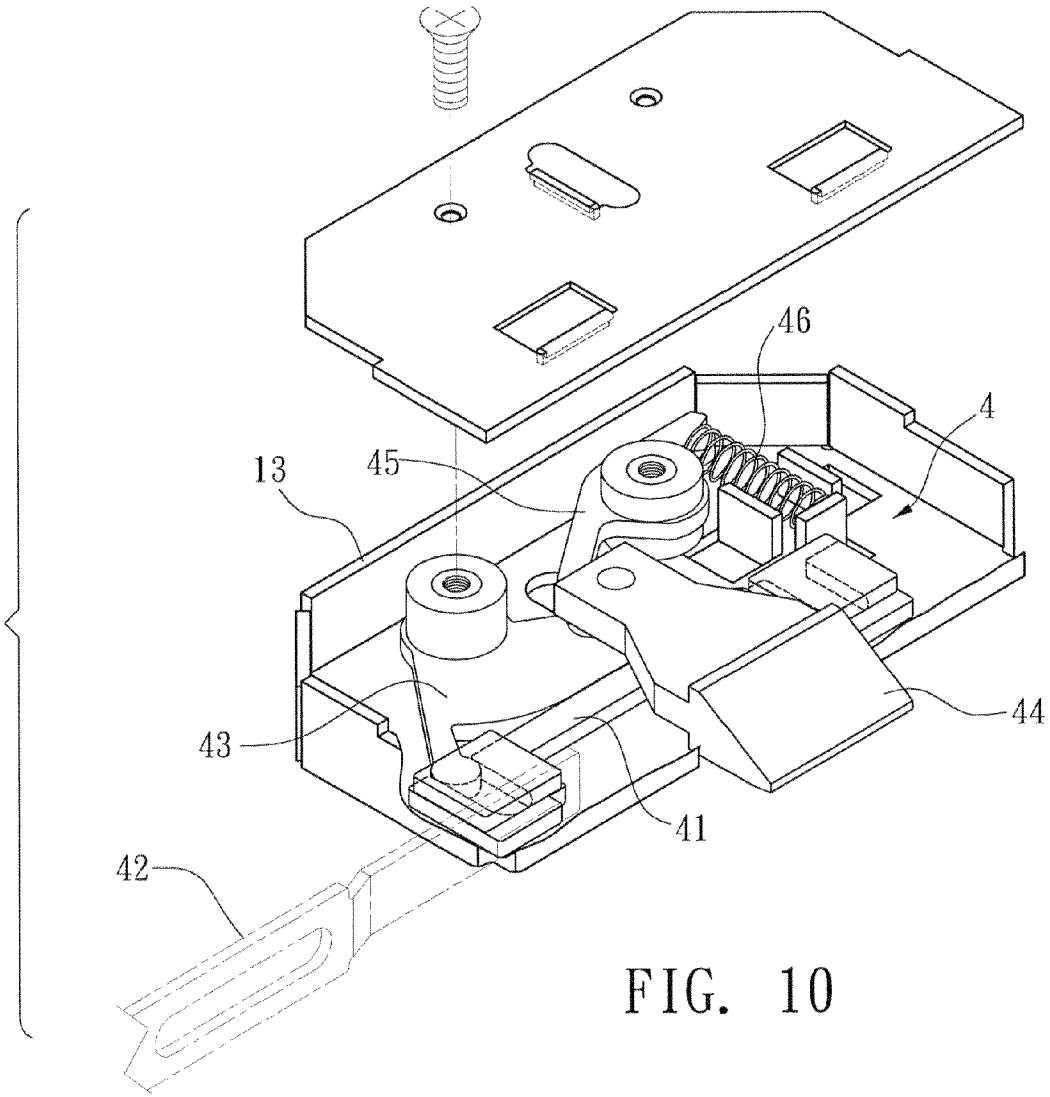
FIG. 10 is a structure schematic drawing showing the right side auxiliary lock of the invention.
Figure 11:
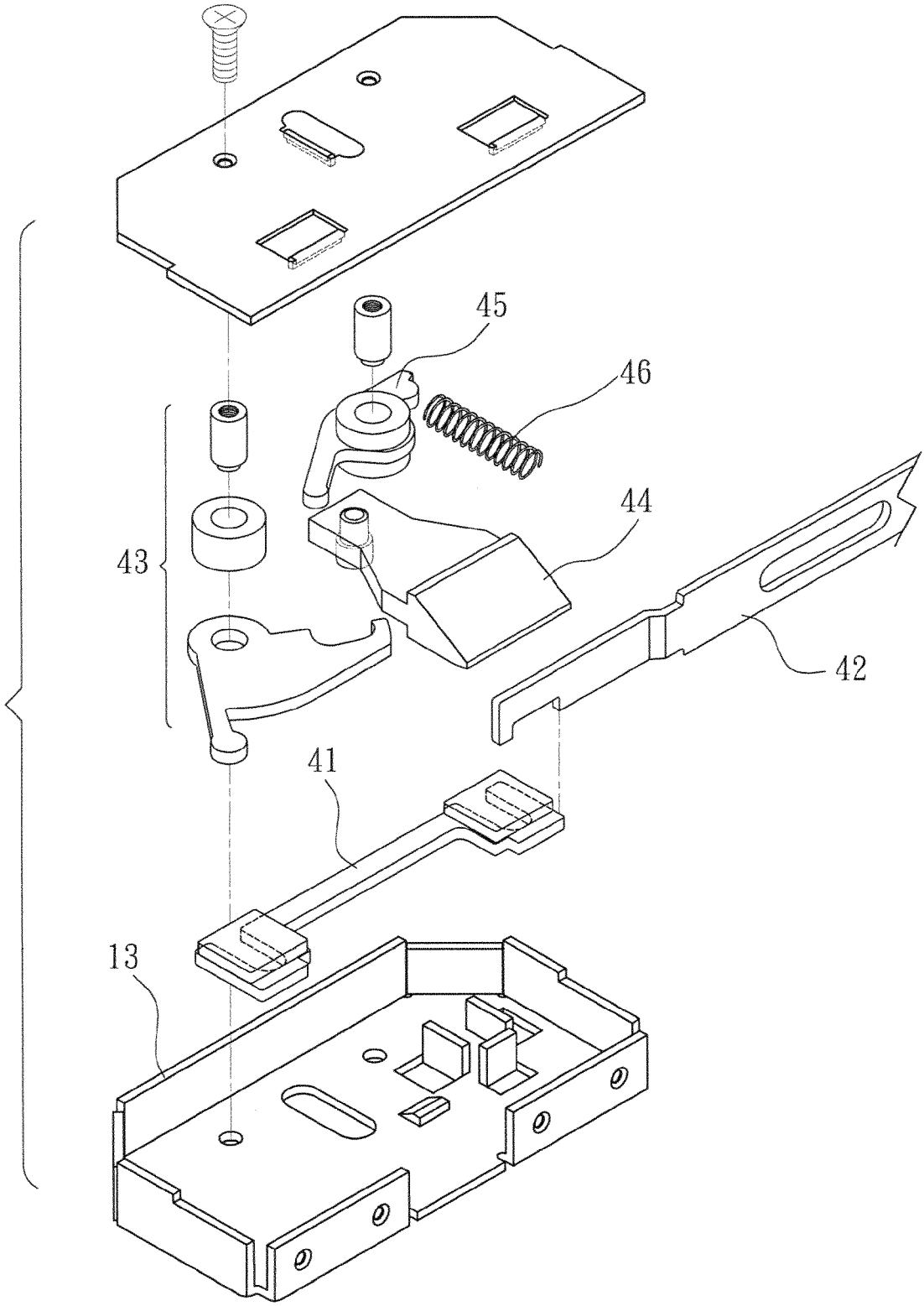
FIG. 11 is a 3D explosion view showing the auxiliary lock of the invention.
Figure 12:
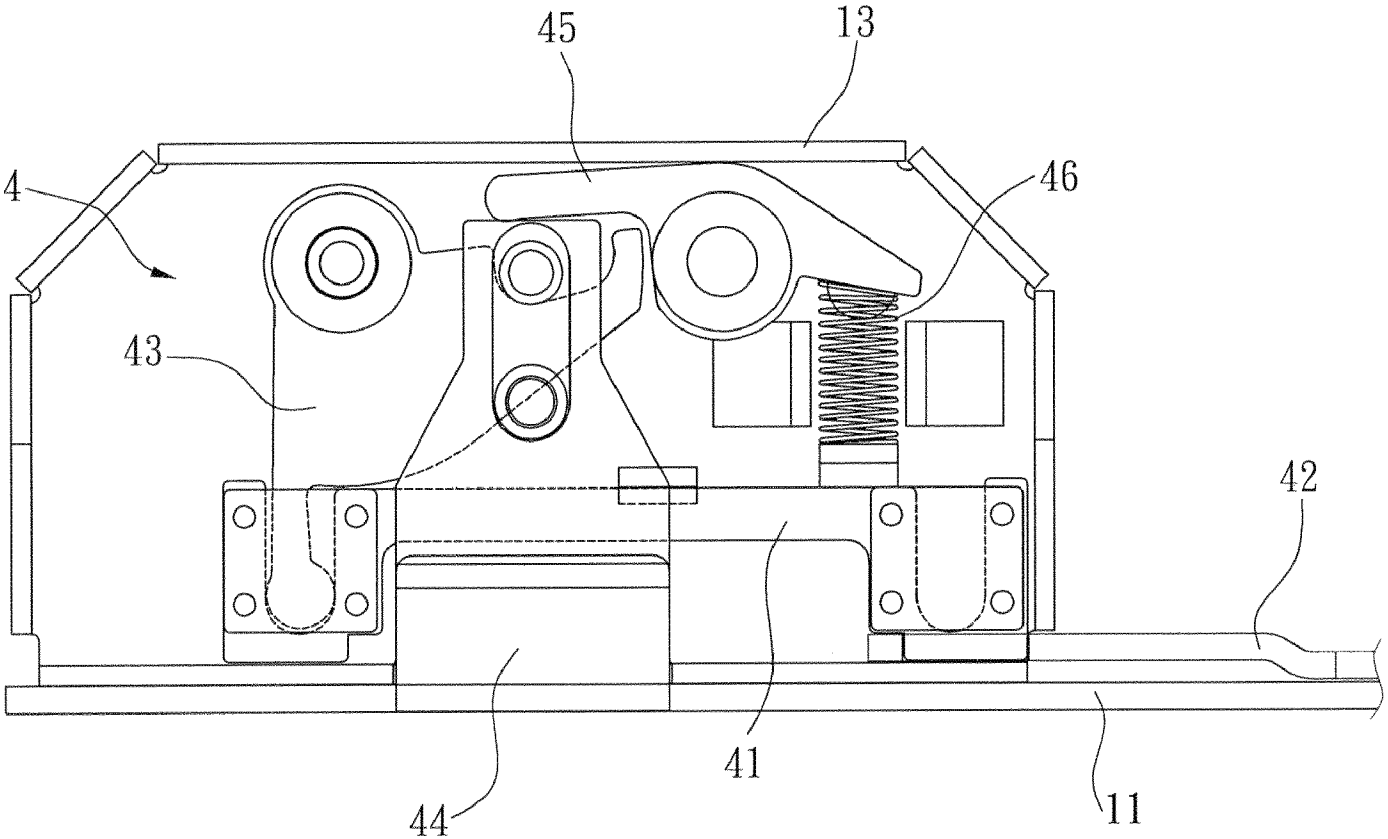
FIG. 12 is a plane schematic view showing a closed auxiliary lock of the invention.
Figure 13:
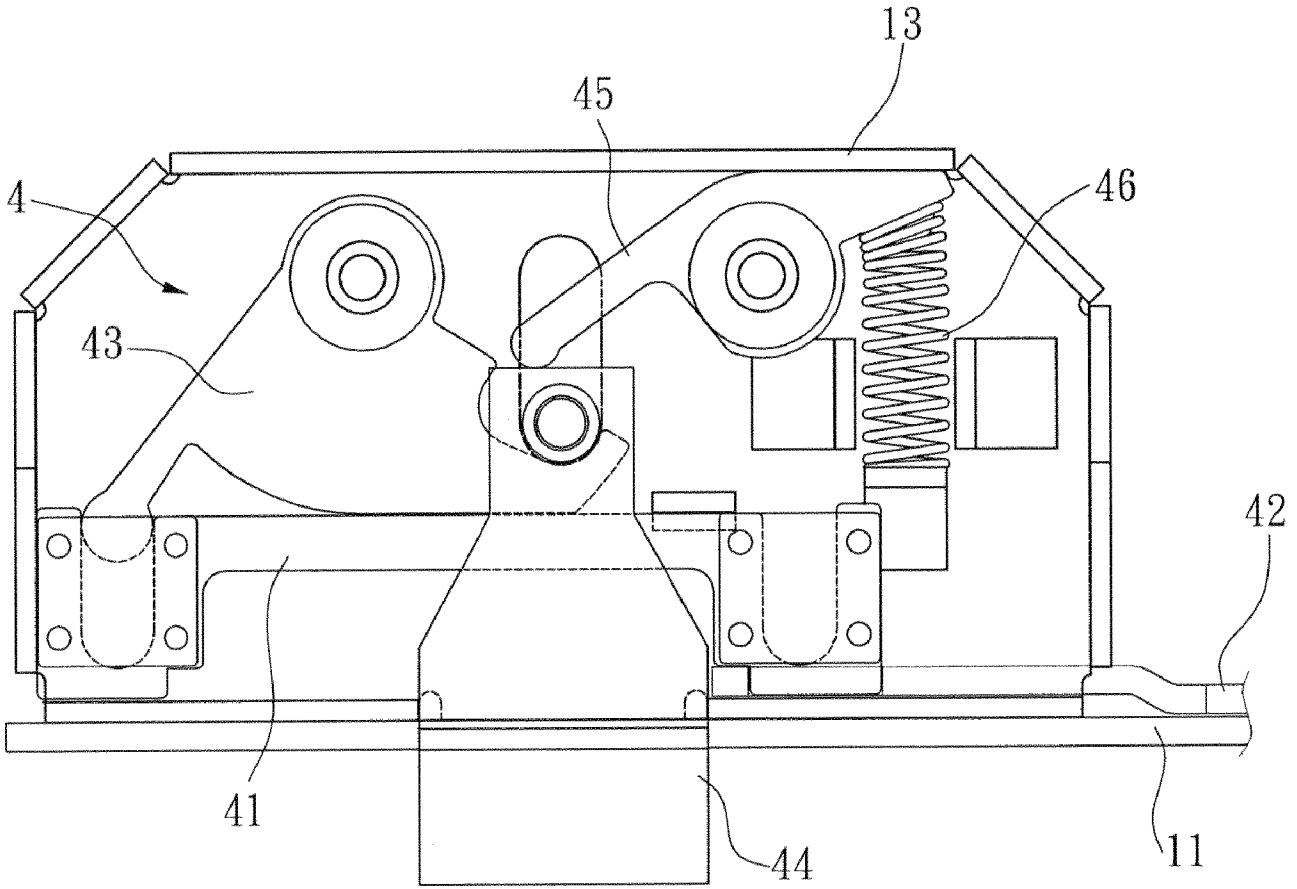
FIG. 13 is a plane schematic view showing an opened auxiliary lock of the invention.

Please refer to FIGS. 1 to 13, whereof the embodiments shown in the drawings are selected by the invention for description purposes, the patent application is not limited by the said embodiments.

The embodiment of the door lock with transmission mechanism is the following:

A lock body 1 is comprised of a stop plate 11 which is closely attached to one side of the door, the middle of the said stop plate 11 is installed with a main lock 12 which is housed inside the door, an auxiliary lock 13 is installed respectively between the main lock 12 and the each end of the stop plate 11 and is housed inside the door similar to the case of main lock 12, whereof the said main lock 12 is installed with a first locking mechanism 2 and a second locking mechanism 3 while each auxiliary lock 13 is installed with a stop mechanism 4.

The said first locking mechanism 2 is comprised of a first actuator 21, whereof one end of the said first actuator 21 is hinged with a first link rod 22 which has a long hole 221 between its two ends. The said long hole 221 is sleeved into a fixed rod 23. The other end of the first link rod 22 is further hinged with a second link rod 24 which is hinged with another lock 25 at its end, whereof the said lock 25 has a lock-head 251 which is extendable to stop plate 11 and recover, whereof the same end of the said second link rod 24 is further installed with a torsion spring 26 which is recover the first link rod 22 back to position after it is moved.

The said second locking mechanism 3 is comprised of a second actuator 31, whereof the second actuator 31 is installed with a second torsion spring 32 for recovering the second actuator 31 after its rotation. One end of the second actuator 31 is installed with a shift-lever 311 to turn a brake 33 which has a shift-part 331, whereof the shift-part 331 is turned to drive a main lock-tongue 34 to extend out of the stop plate 11 and recovered by the push of a third torsion spring 35.

Each of the two stop mechanisms 4 is comprised of a link bar 41 which is connected with a connection bar 42, whereof the connecting bar 42 is extended from the auxiliary lock 13 and entered the two sides of main lock 12, whereof a hinge 43 is driven by the said link bar 41 to connect with one end of a auxiliary lock-tongue 44 in the stop mechanism 4, whereof the said stop mechanism 4 has a pusher 45 which is pushed by a compression spring 46 at one end while its another end push the bottom end of the said auxiliary lock-tongue 44, thereby to recover the lock-tongue 44 after it is moved.

A link plate 5 which is installed in the main lock 11, whereof the link plate 5 is sleeved in the long hole 51 on top of the shift-lever 311 of the second actuator 31 of the second locking mechanism 3, two ends of the said link plate 5 is respectively connected with the connecting bar 42 of each stop mechanism 4, further, the said link plate 5 is sleeved in the shift-part 331 of the second locking mechanism 3, thereby when the brake 33 is turned, the link plate 5 is driven by the shift-part 331 to drive the auxiliary lock-tongue 44 of each stop mechanism 4 for reciprocating movement.

Therefore, it can be seen from the above structure, when the second actuator 31 of the second locking mechanism 3 is rotated, the shift-lever 311 of the second actuator 31 is turned, and the main lock-tongue 34 is pulled by the said brake 33 to extend out of stop plate 11 or recover. In addition, the long hole 51 of said link plate 5 is sleeved into the top of shift-lever 311 of the second actuator 31, whereby when the second actuator 31 is rotated, the long hole 51 of the said link plate 5 is turned by the shift-lever 311, thereby link bar 41 of each stop mechanism 4 and the connecting bar 42 are driven by the link plate 5 so that the auxiliary lock-tongue 44 can be driven by the hinge 43 to extend out of stop plate 11 or recover.

Therefore, through rotating the second actuator 31, the main lock-tongue 34 and the auxiliary lock-tongue 44 can be driven to extend out of stop plate 11 or recover, thereby to avoid the door lock on the door to be pried out easily and improve the strength of door as well as the burglarproof effect.

The invention claimed is:

1. A door lock with transmission mechanism comprising:

a lock body having a stop plate, which is attached to a door and has a middle and two ends, a main lock, which is housed inside the door, and two auxiliary locks, each auxiliary lock is installed between the main lock and one end of the stop plate and housed inside the door, wherein the main lock has a first locking mechanism and a second locking mechanism and each auxiliary lock has a stop mechanism, the first locking mechanism has a first actuator and a first link rod with two ends and a first long hole between these two ends, one end of the said first actuator being hinged on the first link rod, the first long hole is sleeved into a fixed rod, other end of the first link rod being hinged on a second link rod with a first end and a second end, the second link rod being hinged on a fourth lock at the second end of the second link rod, the fourth lock having a lock-head, which can be extended to the stop plate and retracted from the stop plate, the second end of the second link rod being installed with a torsion spring to recover the first link rod back to position after it is moved, the second locking mechanism has a second actuator, the second actuator being installed with a second torsion spring for recovering the second actuator, the second actuator having a first end with a shift-lever that turns a brake, the brake has a shift-part for driving a main lock-tongue out of the stop plate, the main lock-tongue being recovered by a third torsion spring, the stop mechanism on each auxiliary lock has a link bar connected to a connection bar, the connecting bar extends from the auxiliary lock and enters into the main lock, the link bar drives a hinge inside the auxiliary lock that is connected to a auxiliary lock-tongue in the stop mechanism, the stop mechanism has a pusher actuated by a compression spring, and a link plate with two ends is installed in the main lock, the link plate being sleeved in a second long hole on top of the shift-lever of the second actuator of the second locking mechanism, each end of the said link plate is connected with to the connecting bar of one stop mechanism, the link plate is sleeved in the shift-part of the second locking mechanism, thereby when the brake is turned, the link plate is driven by the shift-part to drive the auxiliary lock-tongue of each stop mechanism.

* * * * *